US010659903B2

(12) United States Patent
Jin et al.

(10) Patent No.: US 10,659,903 B2
(45) Date of Patent: May 19, 2020

(54) APPARATUS AND METHOD FOR WEIGHTING STEREO AUDIO SIGNALS

(71) Applicant: Huawei Technologies Co., Ltd., Shenzhen (CN)

(72) Inventors: Wenyu Jin, Shenzhen (CN); Peter Grosche, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/409,368

(22) Filed: May 10, 2019

(65) Prior Publication Data

US 2019/0306650 A1 Oct. 3, 2019

Related U.S. Application Data

(63) Continuation of application No. PCT/EP2016/077376, filed on Nov. 11, 2016.

(51) Int. Cl.
*H04S 7/00* (2006.01)
*H04R 3/04* (2006.01)
(Continued)

(52) U.S. Cl.
CPC ..... *H04S 7/302* (2013.01); *H04R 3/04* (2013.01); *H04R 5/02* (2013.01); *H04R 5/04* (2013.01);
(Continued)

(58) Field of Classification Search
None
See application file for complete search history.

(56) References Cited

U.S. PATENT DOCUMENTS 5,305,386 A 4/1994 Yamato
5,995,631 A * 11/1999 Kamada ..... H04S 1/002 381/1
(Continued)

FOREIGN PATENT DOCUMENTS

EP 1696702 A1 8/2006
JP S6019400 A 1/1985

OTHER PUBLICATIONS

Kahana et al., "Experiments on the Synthesis of Virtual Acoustic Sources in Automotive Interiors," pp. 218-232, AES 16th International Conference (2016).
(Continued)

*Primary Examiner* — Kenny H Truong
(74) *Attorney, Agent, or Firm* — Leydig, Voit & Mayer, Ltd.

(57) ABSTRACT

A signal generator has a filter bank that provides weighted versions of audio signals to speakers. The weights were derived by identifying a first constraint that limits a weight that can be applied to an audio signal to be provided to a first speaker. A characteristic of a second speaker that affects how a user will perceive audio signals output by that speaker relative to audio signals output by the first speaker was also determined. A second constraint was determined based on the determined characteristic and the first constraint. The weights were then determined so as to minimize a difference between an actual balance of each signal that is expected to be heard by a user and a target balance. The signal generator can achieve sweet spot correction and sound stage widening simultaneously. It also achieves a balanced sound stage, particularly when the speakers are asymmetric.

20 Claims, 6 Drawing Sheets

(51) Int. Cl.

| | |
|---|---|
| ***H04R 5/02*** | (2006.01) |
| ***H04R 5/04*** | (2006.01) |
| ***H04S 3/00*** | (2006.01) |
| ***H04S 1/00*** | (2006.01) |

(52) U.S. Cl.
CPC ..... *H04S 1/002* (2013.01); *H04S 3/008* (2013.01); *G10H 2210/301* (2013.01); *G10H 2210/305* (2013.01); *H04R 2499/11* (2013.01); *H04R 2499/13* (2013.01); *H04S 2400/01* (2013.01)

(56) References Cited

U.S. PATENT DOCUMENTS

| | | | | |
|---|---|---|---|---|
| 2010/0290643 | A1 | 11/2010 | Mihelich et al. | |
| 2014/0072121 | A1* | 3/2014 | Harma ..... | H04S 5/005 381/1 |
| 2017/0230777 | A1* | 8/2017 | Seldess ..... | H04R 3/04 |

OTHER PUBLICATIONS

Glasgal et al., "360° Localization via 4.x RACE Processing," pp. 1-11, Audio Engineering Society, Presented at the 123rd Convention (Oct. 5-8, 2007).

Dudo et al., "Range dependence of the response of a spherical head model," 1998 Acoustical Society of America, pp. 3048-3058, J. Acoust. Soc. Am. 104 (5) (Nov. 1998).

Lossius et al., "DBAP—Distance-Based Amplitude Panning," pp. 1-4 (2009).

Lundkvist et al., "3D-Sound in Car Compartments Based on Loudspeaker Reproduction Using Crosstalk Cancellation," Audio Engineering Society Convention Paper 8335, London, UK, pp. 1-11, Presented at the 130th Convention (May 13-16, 2011).

Kostadinov et al., Evaluation of Distance Based Amplitude Panning for Spatial Audio, ICASSP 2010, pp. 285-288 (2010).

Anonymous, HRTF Data, "The CIPIC HRTF Database," Electrical and Computer Engineering,Retrieved from the internet:https://www.ece.ucdavis.edu/cipic/spatial-sound/hrtf-data, pp. 1-5, UCDAVIS Electrical and Computer Engineering (Jun. 26, 2019).

Glasgel, "360° Localization via 4.x RACE Processing," 123rd Audio Engineering Socity (AES) Convention, New York, NY (Oct. 5-8, 2007).

Kahana et al., "Experiments on the Synthesis of Virtual Acoustic Sources in Automotive Interiors," 16th International Conference, Spatial Sound Reproduction, Institute of Sound and Vibration Research, Southampton University, UK (Mar. 1999).

Algazi et al., "The CIPIC HRTF Database," IEEE Workshop on Applications of Signal Processing to Audio and Acoustics, New Paltz, NY, Institute of Electrical and Electronics Engineers, New York, New York (Oct. 21-24, 2001).

* cited by examiner

APPARATUS AND METHOD FOR WEIGHTING STEREO AUDIO SIGNALS

CROSS-REFERENCE TO RELATED APPLICATIONS

This application is a continuation of International Application No. PCT/EP2016/077376, filed on Nov. 11, 2016, the disclosure of which is hereby incorporated by reference in its entirety.

TECHNICAL FIELD

This disclosure relates to an apparatus and method for weighting audio signals so as to achieve a desired audio effect when those audio signals are heard by a user.

BACKGROUND

Stereo sound playback is commonly used in entertainment systems. It reproduces sound using two or more independent audio channels to create an impression of sound heard from various directions, as with natural hearing. Stereo sound is preferably played through a pair of stereo speakers that are located symmetrically with respect to the user. However, asymmetrical or unbalanced stereo speakers are inevitably encountered in reality. Examples include the stereophonic configuration in cars relative to the driver position and the unbalanced speaker setup on small-scale mobile devices. Asymmetric loudspeaker setups do not create good spatial effects. This is because the stereo image collapses if the listener is out of the sweet spot. In response, many sound images are localized at the position of the closest loudspeaker. This results in narrow soundfield distribution and poor spatial effects.

One common example of an asymmetric speaker arrangement occurs in mobile devices such as smartphones. It is getting more and more popular to equip mobile devices with stereo speakers. However, it is difficult to embed a pair of symmetrical speakers due to hardware constraints (e.g., size, battery), especially for smart phones. One solution is to use the embedded ear-piece receiver as a speaker unit. However, the frequency responses of the receiver and speaker are inevitably different (e.g. due to different baffle sizes), which leads to poor stereo effects and an unbalanced stereo sound image. Equalization of the receiver/speaker responses can address the unbalanced stereo sound image, but it does not achieve sound stage widening.

One option for creating a widened sound stage is to implement virtual source rendering with cross talk cancellation. Previous research explores the possibility of virtual source rendering using an 'irregular' loudspeaker arrangement (see e.g. "360 localisation via 4.x RACE processing" by Glasgel, 123$^{rd}$ AES Convention and "Experiments on the synthesis of virtual acoustic sources in automotive interiors" by Kahana et al, 16$^{th}$ International Conference, Spatial Sound Reproduction). This research is limited to the rendering of a single virtual source. Optimisation for a balanced stereo stage is not considered. Additionally, both methods only consider cases with geometrical asymmetry; they fail to mitigate discrepancies that are due to other asymmetries, such as differences in the natural frequency responses of the two speakers. These methods are thus incapable of optimising the asymmetrical speaker setup on smart phones. They also suffer from poor playback quality (including significant pre-echoes in filter design) and the robustness of soundfield widening effect is limited, especially in difficult car environments.

It is an object of the disclosure to provide concepts for improving the playback of audio signals through unbalanced speaker set ups.

SUMMARY

The foregoing and other objects are achieved by the features of the independent claims. Further implementation forms are apparent from the dependent claims, the description and the figures.

According to a first aspect, a signal generator is provided. The signal generator has a filter bank that is configured to receive at least two audio signals, to apply weights to the audio signals and to provide the weighted versions of the audio signals to at least two speakers. The filter bank may weight the signals such that, when the weighted signals are output by the speakers, it simulates an effect of the speakers being a different distance apart than they actually are. The filter bank in the signal generator is configured to apply weights that were derived by identifying a first constraint that limits a weight that can be applied to an audio signal to be provided to a first speaker. A characteristic of a second speaker that affects how a user will perceive audio signals output by that speaker relative to audio signals output by the first speaker was also determined. A second constraint was determined based on the determined characteristic and the first constraint. The weights were then determined so as to minimize a difference between an actual balance of each signal that is expected to be heard by a user when the weighted signals are output by the speakers and a target balance. The weights to be applied to audio signals that will be provided to the first speaker were further determined in dependence on the first constraint. The weights to be applied to audio signals to be provided to the second speaker were further determined in in dependence on the second constraint. The signal generator can achieve sweet spot correction and sound stage widening simultaneously. It also achieves a balanced sound stage, by applying weights that were determined based on the constraints that affect real-life speakers. The balanced sound stage is further reinforced by taking into account how the constraints of individual speakers affect the user's perception of the audio signals that they output, particularly when those speakers have some form of asymmetric arrangement. That asymmetry may be due to the physical arrangement of the speakers (e.g., one speaker may be more distant from the user than the other, such as in a car) or due to the speakers having different impulse responses (which is often the case in mobile devices).

In a first implementation form of the first aspect, the weights applied by the filter bank may have been derived by determining an attenuation factor for stereo balancing in dependence on the characteristic of the second speaker and determining the first constraint in dependence on that attenuation factor. The attenuation factor captures the effect that an asymmetric speaker arrangement has on how the constraints of those respective speakers are perceived by a user. Deriving the filter weights in dependence on the attenuation factor thus improves the balance of the resulting sound stage.

In a second implementation form of the first aspect, the weights applied by the filter bank in any of the above mentioned implementation forms may have been derived by, when the first and second speakers are different distances away from a user, determining the characteristic to be a relative distance of the second speaker from the user compared with the first speaker from the user. This addresses one of the common asymmetries in stereo speaker arrangements: an asymmetry in the physical arrangement of the speakers relative to the user that means audio signals from one speaker have to travel further than audio signals from another speaker to reach the user.

In a third implementation form of the first aspect, the weights of the second implementation form that are applied by the filter bank may have been derived by determining the relative distance to be:

$$(k) = \frac{d1^2}{d2^2},$$

where d1 is the distance between the second speaker and the user and d2 is the distance between the first speaker and the user, wherein k is a frequency index. This captures the effect that having the speakers different distances away from the user can have on how a constraint will be perceived by the user listening to the audio signals, enabling that effect to be compensated.

In a fourth implementation form of the first aspect, the weights of any of the above mentioned implementation forms applied by the filter bank may have been derived by, when the first and second speakers have different frequency responses, determine the characteristic to be a relative frequency response of the second speaker compared with the first speaker. This addresses another common asymmetry in stereo speaker arrangements: an asymmetry in the frequency responses of the speakers that means that a particular frequency band of the audio signal might be amplified differently by each speaker.

In a fifth implementation form of the first aspect, the weights of the fourth implementation form applied by the filter bank may have been derived by determining the relative frequency response to be:

$$(k) = \frac{|t1(k)|^2}{|t2(k)|^2},$$

where $t_1(k)$ is the impulse response of the second speaker and $t_2(k)$ is the impulse response of the first speaker, wherein k is a frequency index. This captures the effect that having speakers with different frequency responses can have on how a constraint will be perceived by the user listening to the audio signals, enabling that effect to be compensated.

In a sixth implementation form of the first aspect, the weights of any of the above mentioned implementation forms applied by the filter bank may have been derived by determining the first constraint to be a maximum gain associated with two or more speakers. This limits the weights so that playback of the resulting audio signals by the speakers is practically realisable.

In a seventh implementation form of the first aspect, for the case of the signal generator being used for providing the audio signals to at least two speakers in a car, the first constraint of the sixth implementation form may be a maximum gain associated with the more distant speaker to the user. This accounts for the fact that audio signals from the more distant speaker have to travel further to reach the user, and thus will typically have to be amplified more at playback if they are to be perceived by the user as having the same volume as audio signals from the other speaker.

In an eighth implementation form of the first aspect, the weights of any of the above mentioned implementation forms applied by the filter bank may have been derived by determining the weights such that a sum of the squares of the weights to be applied to the audio signals to be provided to one of the speakers does not exceed the constraint for that speaker. This helps to ensure that the derived weights do not exceed what is practically realisable in a real-world speaker arrangement.

In a ninth implementation form of the first aspect, the weights of any of the above mentioned implementation forms applied by the filter bank may have been derived by determining the target balance in dependence on a physical arrangement of the two or more speakers relative to a user. This enable the filter weights to compensate for asymmetry in the physical arrangements of the speakers.

In a tenth implementation form of the first aspect, the weights of any of the above mentioned implementation forms applied by the filter bank may have been derived by determining the target balance so as to simulate speakers that are symmetrically arranged with respect to the user. The user may be represented by a user head model, and the target balance may aim to reproduce a virtual speaker arrangement that is symmetric around that head model. This enables the weights to create the effect of a balanced sound stage at the user.

In an eleventh implementation form of the first aspect, the weights of any of the above mentioned implementation forms applied by the filter bank may have been derived by determining the target balance so as to simulate speakers that are further apart than the two or more speakers. This has the effect of widening the sound stage.

According to a second aspect, a method is provided that comprises receiving at least two audio signals, applying weights to the audio signals and providing the weighted versions of the audio signals to at least two speakers. The weights applied to the audio signals were derived by identifying a first constraint that limits a weight that can be applied to an audio signal to be provided to a first speaker. A characteristic of a second speaker that affects how a user will perceive audio signals output by that speaker relative to audio signals output by the first speaker was also determined. A second constraint was determined based on the determined characteristic and the first constraint. The weights were then determined so as to minimize a difference between an actual balance of each signal that is expected to be heard by a user when the weighted signals are output by the speakers and a target balance. The weights to be applied to audio signals that will be provided to the first speaker were further determined in dependence on the first constraint. The weights to be applied to audio signals to be provided to the second speaker were further determined in in dependence on the second constraint.

According to a third aspect, a non-transitory machine readable storage medium having stored thereon processor executable instructions is provided for controlling a computer to implement a method that comprises receiving at least two audio signals, applying weights to the audio signals and providing the weighted versions of the audio signals to at least two speakers. The weights applied to the audio signals were derived by identifying a first constraint that limits a weight that can be applied to an audio signal to be provided to a first speaker. A characteristic of a second speaker that affects how a user will perceive audio signals output by that speaker relative to audio signals output by the first speaker was also determined. A second constraint was determined based on the determined characteristic and the first constraint. The weights were then determined so as to minimize a difference between an actual balance of each signal that is expected to be heard by a user when the weighted signals are output by the speakers and a target balance. The weights to be applied to audio signals that will be provided to the first speaker were further determined in dependence on the first constraint. The weights to be applied to audio signals to be provided to the second speaker were further determined in in dependence on the second constraint.

BRIEF DESCRIPTION OF DRAWINGS

The present disclosure will now be described by way of example with reference to the accompanying drawings. In the drawings.

DETAILED DESCRIPTION OF EMBODIMENTS

Figure 1:
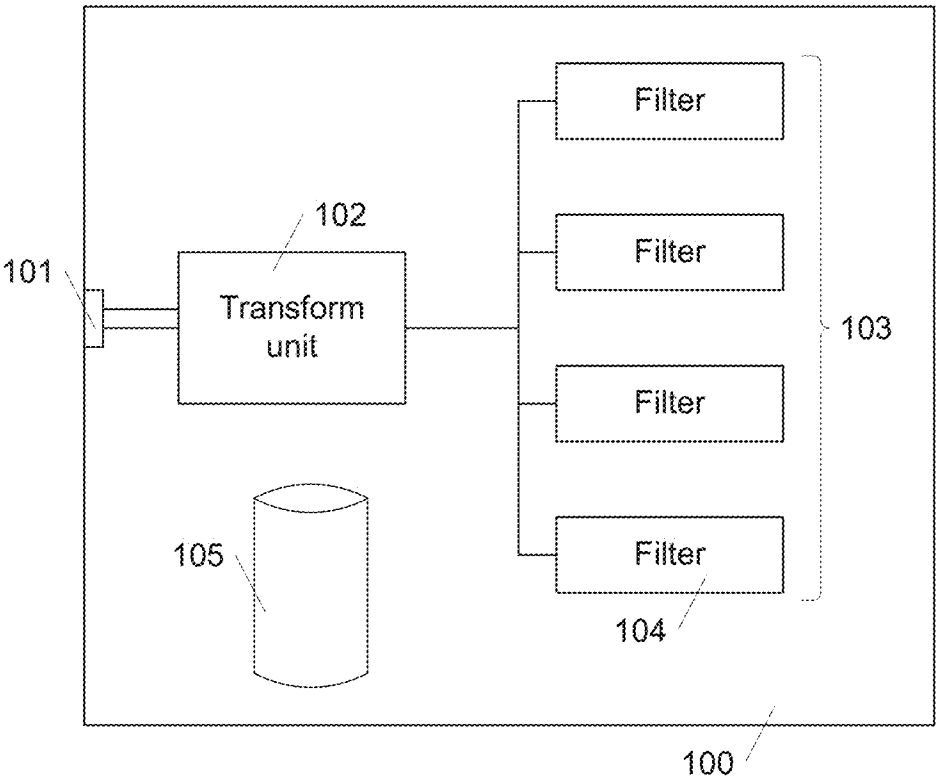
FIG. 1 shows a signal generator according to one embodiment of the disclosure.

An example of a signal generator is shown in FIG. 1. The signal generator 100 comprises an input 101 for receiving two or more audio signals. These audio signals represent different channels for a stereo sound system and are thus intended for different speakers. The signal generator comprises an optional transform unit 102 for decomposing each audio signal into its respective frequency components by applying a Fourier transform to that signal. In other implementations the filter bank 103 might perform all the segmentation of the audio signals that is required. The filter bank comprises a plurality of individual filters 104. Each individual filter may be configured to filter a particular frequency band of the audio signals. The filters may be band-pass filters. Each filter may be configured to apply a weight to the audio signal. Those weights are typically precalculated with a separate weight being applied to each frequency band.

The precalculated weights are preferably derived using a multi-constraint optimisation technique that is described in more detail below. This technique is adapted to derive weights that can achieve sound stage balancing for asymmetric speaker arrangements. A speaker arrangement might be asymmetric due to one speaker being more distant from one speaker than from another speaker (e.g. in a car). A speaker arrangement might be asymmetric due to one speaker having a different impulse response from another speaker (e.g. in a smartphone scenario). The sound generator (100) is configured to achieve a sound stage widening and sweet spot correction simultaneously.

In some embodiments, the signal generator may include a data store 105 for storing a plurality of different sets of filter weights. Each filter set might be applicable to a different scenario. The filter bank may be configured to use a set of filter weights in dependence on user input and/or internally or externally generated observations that suggest a particular scenario is applicable. For example, where the signal generator is providing audio signals to a stereo system in a car, the user might usually want to optimise the sound stage for the driver but the sound stage could also be optimised for one of the passengers. This might be an option that a user could select via a user interface associated with the car stereo system. In another example, the appropriate weights to achieve sound stage optimisation might depend on how a mobile device such as a smart phone is being used. For example, different weights might be appropriate if the device's sensors indicate that it is positioned horizontally on a flat surface from if sensor outputs indicate that the device is positioned vertically and possibly near the user's face.

In many implementations the signal generator is likely to form part of a larger device. That device could be, for example, a mobile phone, smart phone, tablet, laptop, stereo system or any generic user equipment, particularly user equipment with audio playback capability.

The structures shown in FIG. 1 (and all the block apparatus diagrams included herein) are intended to correspond to a number of functional blocks. This is for illustrative purposes only. FIG. 1 is not intended to define a strict division between different parts of hardware on a chip or between different programs, procedures or functions in software. In some embodiments, some or all of the signal processing techniques described herein are likely to be performed wholly or partly in hardware. This particularly applies to techniques incorporating repetitive operations such as Fourier transforms and filtering. In some implementations, at least some of the functional blocks are likely to be implemented wholly or partly by a processor acting under software control. Any such software may be stored on a non-transitory machine readable storage medium. The processor could, for example, be a DSP of a mobile phone, smart phone, stereo system or any generic user equipment with audio playback capability.

Figure 2:
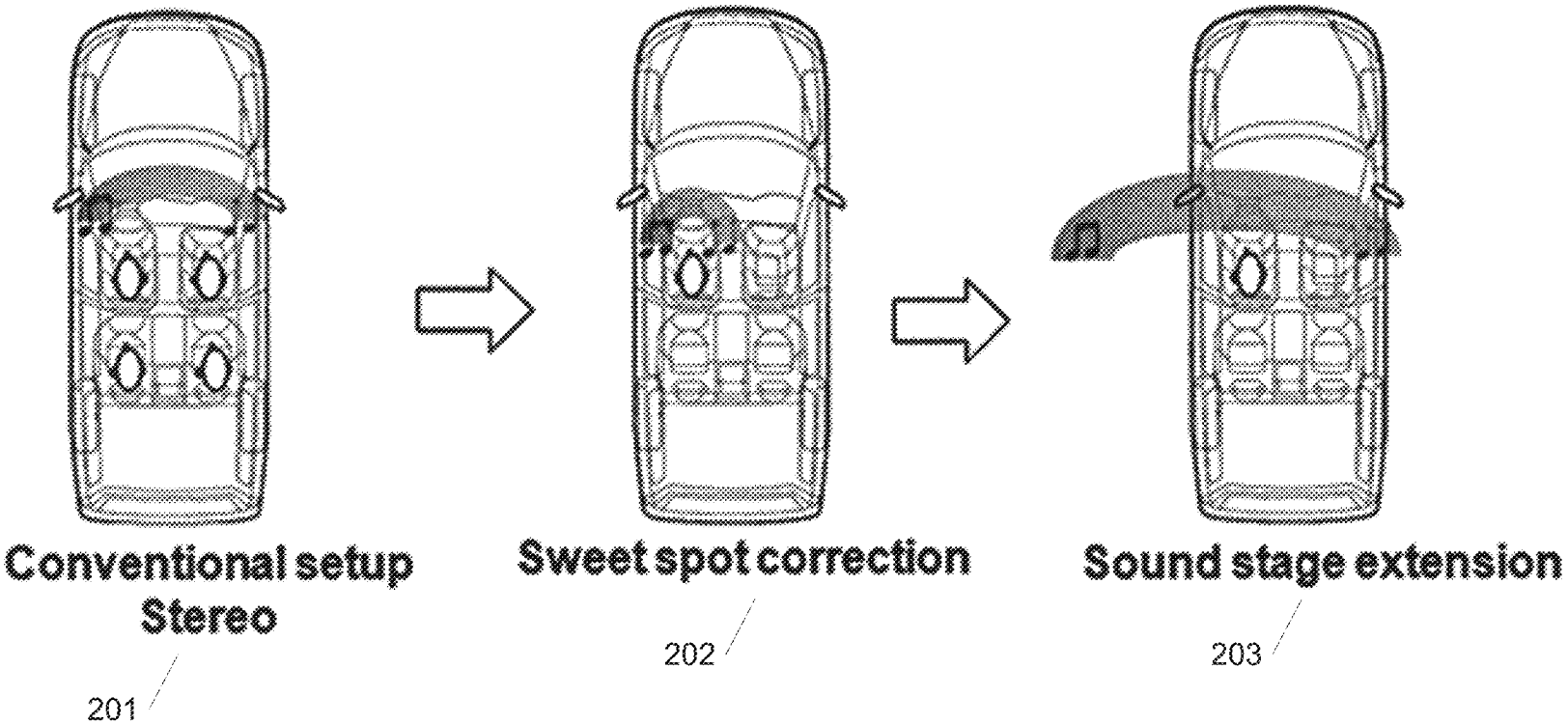
FIG. 2 is a comparison between a conventional stereophonic configuration in a car and a sound stage extension.

One common example of an asymmetric speaker arrangement occurs in cars. This is a scenario in which sound stage widening can be particularly beneficial. FIG. 2 illustrates a comparison between the conventional stereophonic configuration in a car and the sound stage extension. For the conventional stereo setup (201), the generated soundfield distribution is narrow and suboptimal for all passengers, especially for the driver due to the off-centre listening position. The constrained loudspeaker placement results in an unflexible, fixed setup. One option is to employ sweet spot correction methods based on delay and gain adjustment (202). This redefines the stereo sound stage for a respective listening position (e.g. that of the driver). The system then has a very narrow sound stage, which does not create decent spatial effects. A preferred option is to widen the sound stage by creating a "virtual speaker" that is located further away from the other speaker than the real speaker actually is (203). In FIG. 2 this is shown as a virtual speaker that is located out of the car, representing the sound widening effect experienced by a listener.

Figure 3:
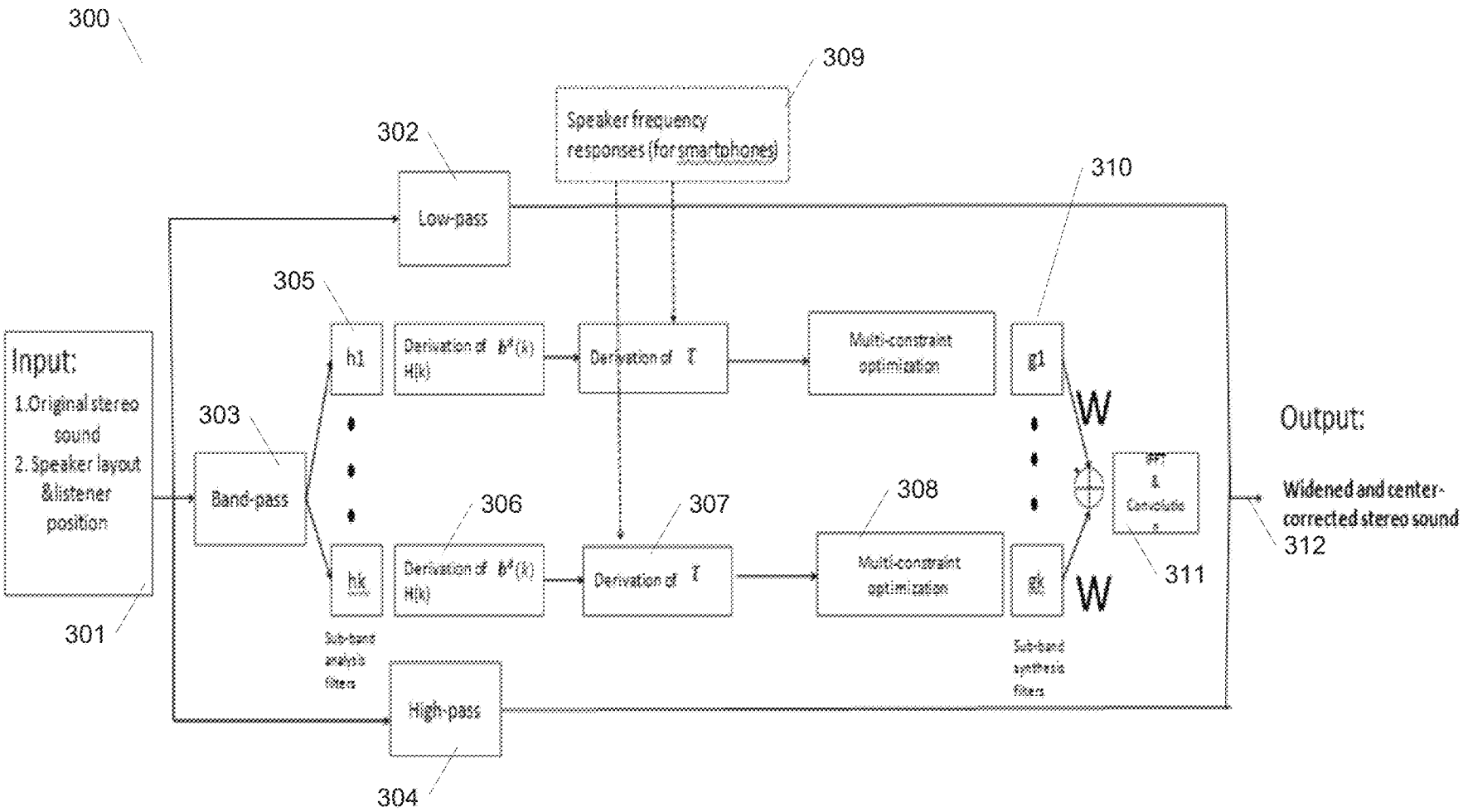
FIG. 3 shows a signal structure for deriving weights to apply to audio signals.
Figure 6:
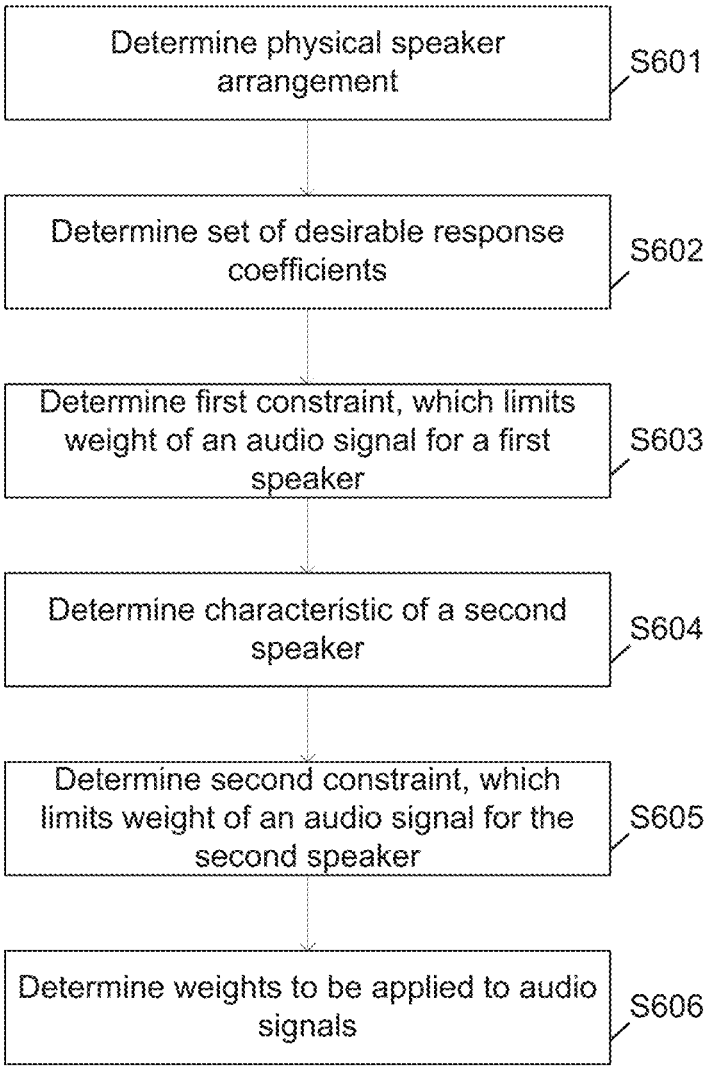
FIG. 6 shows an example of a method for deriving weights to apply to audio signals.

An example of a system structure for determining filter weights that can be used to address the type of unbalanced speaker arrangement illustrated in FIG. 2 is shown in FIG. 3. The system structure includes functional blocks that aim to mimic what happens to stereo audio signals when they are output by a loudspeaker. It also includes functional blocks for the calculating filter weights that can rebalance the stereo sound stage for asymmetric speaker arrangements. These functional blocks are described in more detail below with reference to the process for generating filter weights that is illustrated in FIG. 6. In most practical implementations, the filter weights are expected to be precalculated and stored in the filter bank 103 of signal generator 100.

The system structure has, as its inputs 301, the original left and right stereo sound signals. These are audio signals for being output by a loudspeaker. The system structure is described below with specific reference to an example that involves two audio signals: one for a left-hand speaker and one for a right-hand speaker, but the techniques described below can be readily extended to more than two audio channels.

Figure 4:
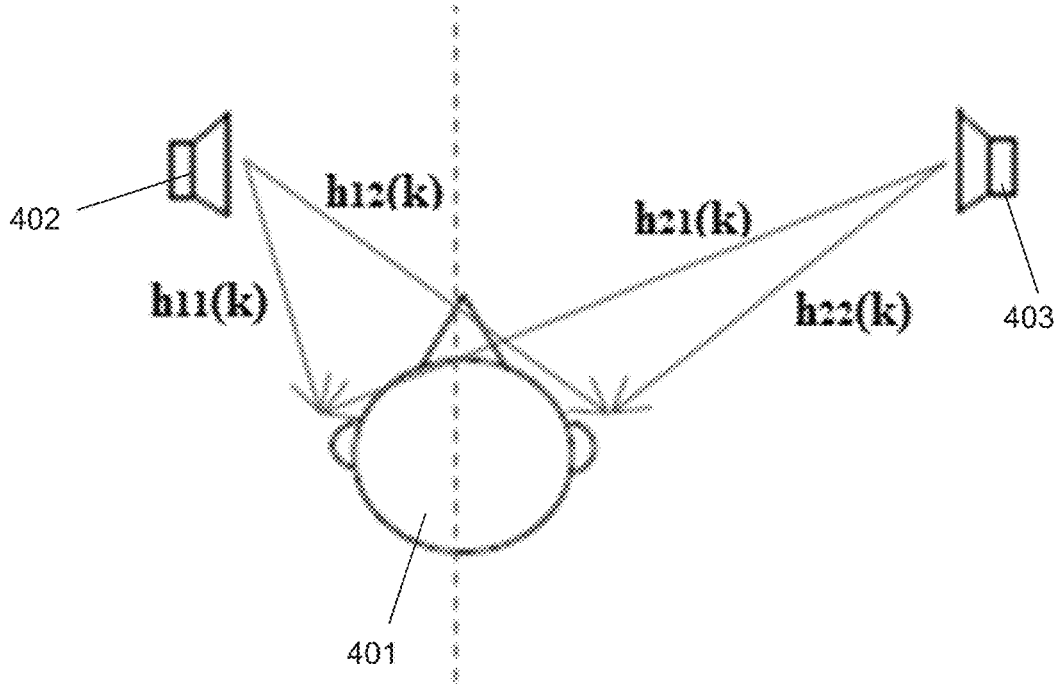
FIG. 4 shows an example of a listener and an asymmetric speaker arrangement.

Functional blocks 302 to 305 are largely configured to mimic what happens as the input audio signals 301 are output by a loudspeaker and travel through the air to be heard by a listener. Very low and high frequencies are expected to be bypassed, which is represented in the system structure of FIG. 3 by low-pass filter 302 and high-pass filter 304. This assumption is appropriate due to both the limited size of the devices in most scenarios (e.g. a car scenario and a smartphone scenario) and the fact that only two speakers are expected in most implementations. Suitable low and high cut-off frequencies are around 300 Hz and 7 kHz respectively. The band-pass filter 303 segments the audio signals into sub-bands and performs a Fast Fourier Transform. This prepares the audio signals for the next stage of the synthesised process, in which different frequency bands of the audio signal are effectively subject to different transfer functions as they travel through the air, due to the frequency-dependent nature of those transfer functions. The sub-band analysis filters 305 represent the transfer functions that are applied to the audio signals as they travel from the loudspeakers to the listener's ear. This is shown in FIG. 4.

The frequency-dependent transfer functions $h_{ml}(k)$ for sound propagation from the loudspeakers to a listener's ears are determined by the positions of the loudspeakers and the positions of the listener's ears. This is illustrated in FIG. 4, which shows a listener 401 positioned asymmetrically with respect to left and right loudspeakers 402, 403. The index m identifies an ear of the listener (e.g. m=1 for the left ear and m=2 for the right ear) and the index l identifies a loudspeaker (e.g., l=1 for the left speaker and l=2 for the right speaker). The transfer functions $h_{ml}(k)$ (with m, $l\in\{1; 2\}$) can be arranged in a 2×2 matrix H(k). The matrix H(k) is also known as the plant matrix.

$$H(k) = \begin{bmatrix} h_{11}(k) & h_{12}(k) \\ h_{21}(k) & h_{22}(k) \end{bmatrix} \tag{1}$$

$h_{11}(k)$, $h_{12}(k)$, $h_{21}(k)$, $h_{22}(k)$ can be determined using the spherical head model, based on the respective loudspeaker and listener positions.

In the system of FIG. 3 the sub-band analysis filters are followed by a coefficient derivation unit 306, a constraint derivation unit 307 and a multi-constraint optimisation unit 308. These functional units are configured to work together determine appropriate filter weights for addressing an asymmetrical speaker setup. The theory that underpins the determination of the filter weights is outlined below.

For each frequency bin k, it is possible to formulate an optimization with two (and possibly more than two) constraints. This formulation starts by denoting a loudspeaker weights matrix, of dimension 2×2:

$$W(k) = \begin{bmatrix} w_{11}(k) & w_{12}(k) \\ w_{21}(k) & w_{22}(k) \end{bmatrix} \tag{2}$$

The diagonal elements of W(k) represent the ipsilateral filter gains for the left stereo channel and for the right stereo channel. The off-diagonal elements represent the contralateral filter gains for the two channels. The gains are specific to frequency bins, so the matrix is in the frequency domain.

The short-time Fourier transform (STFT) coefficients for the stereo sound signals can be denoted $s_n(k)$ ($n\in\{1,2\}$) where n is the channel index. The STFT coefficients can be computed by dividing the audio signal into short segments of equal length and then computing an FFT separately on each short segment. The STFT coefficients thus have an amplitude and a time extension. The left channel has n=1, the right channel has n=2. The playback signal which drives the l-th speaker can therefore be written as:

$$x_l(k) = \sum_{n=1}^{2} w_{ln}(k) s_n(k) \tag{3}$$

where $l\in\{1,2\}$. This represents an audio signal that is bandpass filtered into separate frequency bins, with each frequency bin being separately weighted before playback.

Referring to the physical arrangement of the two speakers relative to the user that is illustrated in FIG. 4, it can be seen that the audio signal that arrives at ear m for frequency bin k is given by:

$$y_m(k) = \sum_{l=1}^{2} h_{ml}(k) \sum_{n=1}^{2} w_{ln}(k) s_n(k) \tag{4}$$

where $m\in\{1; 2\}$.

The weights applied to the audio signals by the loudspeakers thus combine with the transfer functions determined using the spherical head model to form response coefficients $b_{mn}(k)$:

$$b_{mn}(k) = \sum_{l=1}^{2} h_{ml}(k) \sum_{n=1}^{2} w_{ln}(k) \tag{5}$$

The response coefficients transform the left and right channel signals $s_1(k)$ and $s_2(k)$ into the signals $y_m(k)$ ($m\in\{1; 2\}$) that are perceived by the listener. The weights $w_{ln}(k)$ can, in principle, be freely chosen. The transfer functions $h_{ml}(k)$ are fixed by the geometry of the system.

The aim is to choose weights $w_{ln}(k)$ for the actual setup such that the resulting response coefficients $b_{mn}(k)$ are identical or at least close to the response coefficients of a desired virtual setup:

$$\hat{b}_{mn}(k) = \sum_{l=1}^{2} \hat{h}_{ml}(k) \sum_{n=1}^{2} \hat{w}_{ln}(k) \tag{6}$$

The (2×2)-matrix $\hat{b}(k)=[\hat{b}_{mn}(k)]$ associated with the virtual setup represents a desired frequency response observed at listener's ears. The target matrix $\hat{b}(k)$ is preferably selected such that the resulting filters show minimal pre-echoes, which leads to good quality playback and better sound widening perception.

Figure 5:
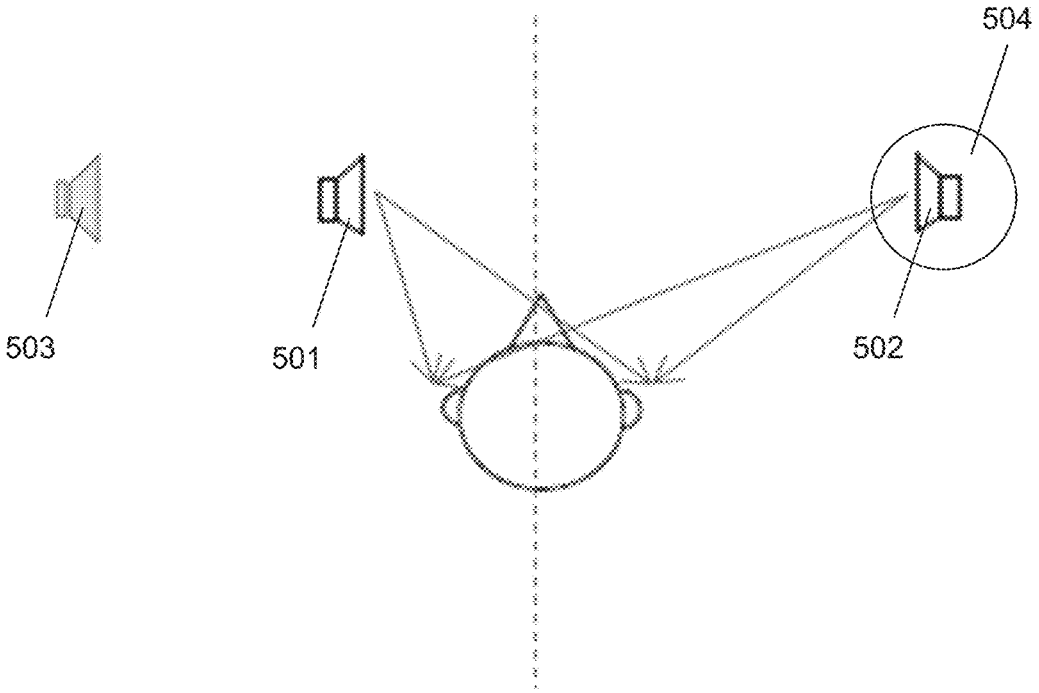
FIG. 5 shows an example of a listener and a virtually widened speaker arrangement that achieves a balanced speaker set-up.

The desired virtual setup is an imaginary setup in which the two loudspeakers are positioned more favourably than in the actual setup, in terms of both sound stage widening and good playback quality. An example of a desired virtual set-up is shown in FIG. 5. This figure illustrates a car scenario, in which the two actual loudspeakers 501, 502 are asymmetrically arranged with respect to the user. In the desired set-up, the two virtual loudspeakers 503, 504 are symmetrically arranged with respect to the user (who is the car driver in this example). In the example of FIG. 5, one of the two virtual speakers coincides with the distant speaker of the real system (this is the right-side speaker (l=2) of the real setup).

For car scenarios, in which two loudspeakers are usually asymmetrically positioned with respect to the driver, it is often desirable to physically widen at least one of the speakers. Referring to the physical arrangement of the two speakers relative to the user that is illustrated in FIG. 4, the first column of the $\hat{b}(k)$ matrix in the car scenario of FIG. 5 represents the frequency response of the desired left-hand virtual speaker. This desired speaker is symmetrical to the right-hand physical speaker. The right-hand speaker is relatively distant from the driver and thus sufficiently wide. The second column of the $\hat{b}(k)$ matrix in the car scenario of FIG. 5 represents the frequency response of the desired right-hand virtual speaker. The right-hand virtual speaker may be placed near the right-hand physical speaker, preferably at exactly the same position. The ideal arrangement is to simulate a speaker arrangement in which the speakers are: (i) symmetrically arranged with respect to the user; and (ii) provide a wide sound stage.

For smart phone scenarios, the two loudspeakers are usually symmetrically positioned with respect to the user. In this scenario the first and second columns of the $\hat{b}(k)$ matrix may represent the frequency responses of a symmetrical pair of left and right virtual speakers, with those virtual sources having a wider spatial interval than the physical speakers. The asymmetry in the smart phone scenario is linked to the frequency responses of the speakers rather than their physical arrangement. The two physical speakers are likely to have different frequency responses.

Returning to the system structure of FIG. 3, the first stage in determining an appropriate set of filter weights is for the coefficient derivation unit 306 to determine the plant matrix H(k) for the physical speaker arrangement and a set of desirable response coefficients $\hat{b}(k)$. This is also represented by steps S601 and S602 of FIG. 6.

One option would be for the system to determine the filter weights directly as soon as the plant matrix and the set of desirable response coefficients have been determined (e.g. by means of equation (6)). This is not optimal, however, as it does not account for one or more constraints that are inherent in the physical speaker arrangement, and that can affect how the user will perceive the audio signals output by the different speakers. In particular, there may be physical constraints that limit a weight that can applied to audio signals before they are supplied to a physical loudspeaker. One such constraint is associated with the upper gain limit for a particular loudspeaker. This constraint may be denoted N.

In the system structure of FIG. 3, the constraint derivation unit 307 is configured to determine constraints that limit a weight that can be applied to audio signals intended for playback by particular loudspeakers (step S603). For a two speaker arrangement, these constraints may be denoted as a first constraint $N_1$ and a second constraint $N_2$. They can be defined as follows:

$$\|w(1,:)(k)\|^2 \leq N_1 \text{ that is, } \Sigma_{n=1}{}^2 |w_{1,n}(k)|^2 \leq N_1, \text{ and}$$

$$\|w(2,:)(k)\|^2 \leq N_2, \text{ that is } \Sigma_{n=1}{}^2 |w_{2,n}(k)|^2 \leq N_2 \quad (7)$$

So the sum of the squares of the weights for each speaker should not exceed the constraint for that speaker.

The constraint derivation unit may determine that one of the constraints is set by a maximum gain associated with both speakers. This sets an upper limit on the filter gain for either speaker. For example, if the two loudspeakers have different gain limits, the upper limit for the speaker pair may be the lower of those gain limits. The upper limit might also be affected by the loudspeakers respective positions with respect to the user and/or their respective frequency responses. For example, if the two loudspeakers are asymmetrically positioned with respect to the user, the upper limit may be determined by the loudspeaker that is the further away of the two. This is particularly expected to apply to the case where the audio signals are provided to speakers in a car. For mobile devices, it will usually be the case that either speaker can provide the upper gain limit. This is described in more detail below with respect to the scenario illustrated in FIG. 4 in which the speakers are asymmetrically arranged with respect to the user.

The constraint derivation unit 307 may be configured to use a preset upper gain limit—6 dB might be a suitable example—and assign this to whichever speaker the upper limit is considered more appropriate to. For example, in FIG. 4 the right-hand speaker (denoted speaker 2 in this example) is located further away from the user so the audio signals that it outputs will have to be louder than the audio signals output by the left-hand speaker (denoted speaker 1 in this example) for the user to perceive both audio signals as having the same volume. The right-hand speaker may thus be associated with the preset upper limit, meaning that $N_2$ is set to 6 dB. If this constraint were ignored, the filter bank might apply weights to the audio signal that would not be reflected in the output audio signal because they exceeded the loudspeaker's playback capability.

Often, the same constraint will not be applicable to all speakers. This can be because of inherent differences between the speakers themselves and/or because of differences in the way those speakers are physically arranged with respect to the user. The constraint derivation unit (307) is preferably configured to address this by determining a characteristic of one speaker that affects how the user will perceive audio signals output by that other speaker relative to audio signals output by another speaker (step S604). The aim is to create a balanced sound stage, in which the user perceives the stereo signals as being output equally by the virtual speakers.

In one example, the constraint derivation unit 307 is configured to quantify this characteristic of the other loudspeaker through determining an attenuation factor for stereo balancing. The attenuation factor is denoted τ(k), and the constraint for the other speaker can be determined as:

$$N_1 = \tau(k) N_2 \quad (8)$$

For a typical car scenario, the constraint derivation unit 307 may assume that the speakers are essentially the same— so they have the same frequency response and the same gain limit—meaning that the characteristic that determines how the user will perceive audio signals is dependent on the relative distances between each respective speaker and the user. In this scenario, τ(k) can be derived using distance-based amplitude panning (DBAP):

$$\tau(k) = \frac{d1^2}{d2^2} \tag{9}$$

In FIG. 4, d1 and d2 represent the distance from the left-hand speaker to the centre of listener's head and from the right-hand speaker to the centre of the user's head respectively.

For a typical smartphone scenario, the constraint derivation unit 307 may assume that the speakers are the same distance from the user but have different frequency responses. In this scenario, τ(k) can be derived from the measured impulse responses of the left and right speaker/receiver:

$$\tau(k) = \frac{|t_l(k)|^2}{|t_r(k)|^{2^2}} \tag{10}$$

where $t_l(k)$ and $t_r(k)$ are the frequency responses of the left-hand and right-hand speakers at frequency k, respectively.

The constraint derivation unit may be provided with the appropriate frequency responses 309. Frequency responses of virtual sources can be determined, for example, based on online CIPIC HRTF databases available from the University of California Davis.

Having determined the characteristic of the second speaker that will affect how the user perceives audio signals output by that speaker compared with audio signals output by the first speaker, the constraint determination unit is able to determine the constraint for the second speaker in dependence on the constraint for the first speaker and the determined characteristic, e.g. by applying equation 8 (step S605).

In the system structure of FIG. 3, the constraint derivation unit (307) is configured to output the constraints to the optimisation unit (308). The optimisation unit may be configured to implement a multi-constraint optimisation that aims to minimize a difference between an actual balance of each audio signal that is expected to be heard by a user when the audio signals are output by the loudspeakers and a target balance. This can be represented as:

$$\min_{W(k)} \left\| H(k)W(k) - \hat{b}(k) \right\|^2$$

subject to:

$$\|w(1,:)(k)\|^2 \leq N_1 \text{ that is, } \Sigma_{n=1}^{2} |w_{1,n}(k)|^2 \leq N_1, \text{ and}$$

$$\|w(2,:)(k)\|^2 \leq N_2, \text{ that is } \Sigma_{n=1}^{2} |w_{2,n}(k)|^2 \leq N_2$$

where H(k)W(k) represents the actual balance of each audio signal that is expected to be heard by the user and $\hat{b}(k)$ represents the target balance. $N_1$ and $N_2$ limit the weight gain in the complex dimension.

As described above, the target balance may aim to simulate a symmetric speaker arrangement, i.e. a physical speaker arrangement in which the speakers are symmetrically arranged with respect to the user (which is achieved by representing the user via a user head model around which the simulated speakers are symmetrically arranged) and/or a speaker arrangement in which both speakers show the same frequency response. The target balance may also aim to simulate a speakers that are further apart than the speakers are in reality.

The optimisation unit 308 is thus capable of generating weights that accurately render the desired virtual source while also satisfying the attenuation constraints of the left channel speaker compared with the right channel speaker. If the optimisation unit applies equation 8, it will find the globally optimal solution in the MMSE (minimum mean square error) sense that minimizes the reproduction error compared with the desired virtual source responses in the complex frequency domain, while also being effectively constrained by the specified filter gain attenuation.

The system structure shown in FIG. 3 is also configured to synthesise the signals that will be output by a signal generator by applying the weights that the optimisation unit (308) has determined. The audio signals are filtered by applying the weights generated by optimisation unit 308 (as represented by filter bank 310). Each frequency band of an audio signal is weighted using the appropriate weight w(k) for that frequency band. The widened and balanced stereo signals are derived by the transform unit 311 performing an FFT and overlap-add operation to generate the resulting signal (312). In effect, filter bank 310 and transform unit 311 mimic functional blocks that are also comprised in the signal generator 100, and which will eventual apply the derived filter weights to form audio signals for playback through two or more speakers.

The structures shown in FIG. 3 (and all the block apparatus diagrams included herein) are intended to correspond to a number of functional blocks. This is for illustrative purposes only. FIG. 3 is not intended to define a strict division between different parts of hardware on a chip or between different programs, procedures or functions in software. In some embodiments, some or all of the signal processing techniques performed by the system structure of FIG. 3 are likely to be performed wholly or partly in hardware. This particularly applies to techniques incorporating repetitive operations such as Fourier transforms, filtering and optimisations. In some implementations, at least some of the functional blocks are likely to be implemented wholly or partly by a processor acting under software control. Any such software is may be stored on a non-transitory machine readable storage medium. The processor could, for example, be a DSP.

Figure 7:
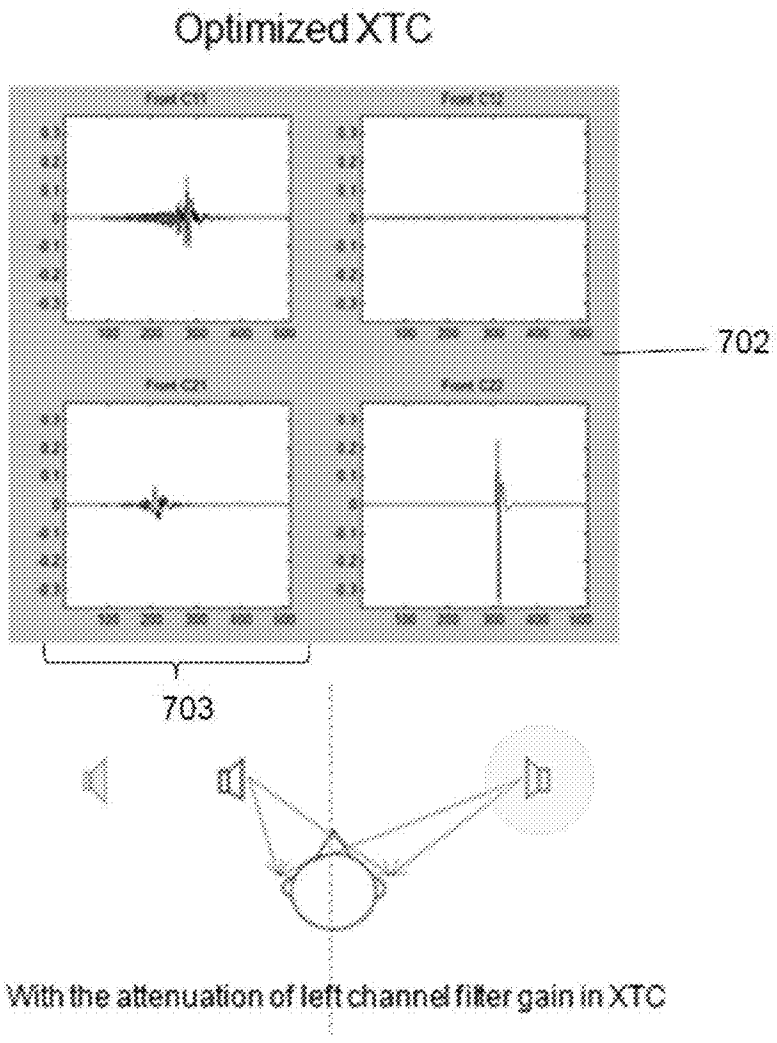
FIG. 7 shows results from a simulation comparing filters using weights derived according to a conventional crosstalki algorithm and weights derived using a multi-constraint optimisation.
Figure 7:
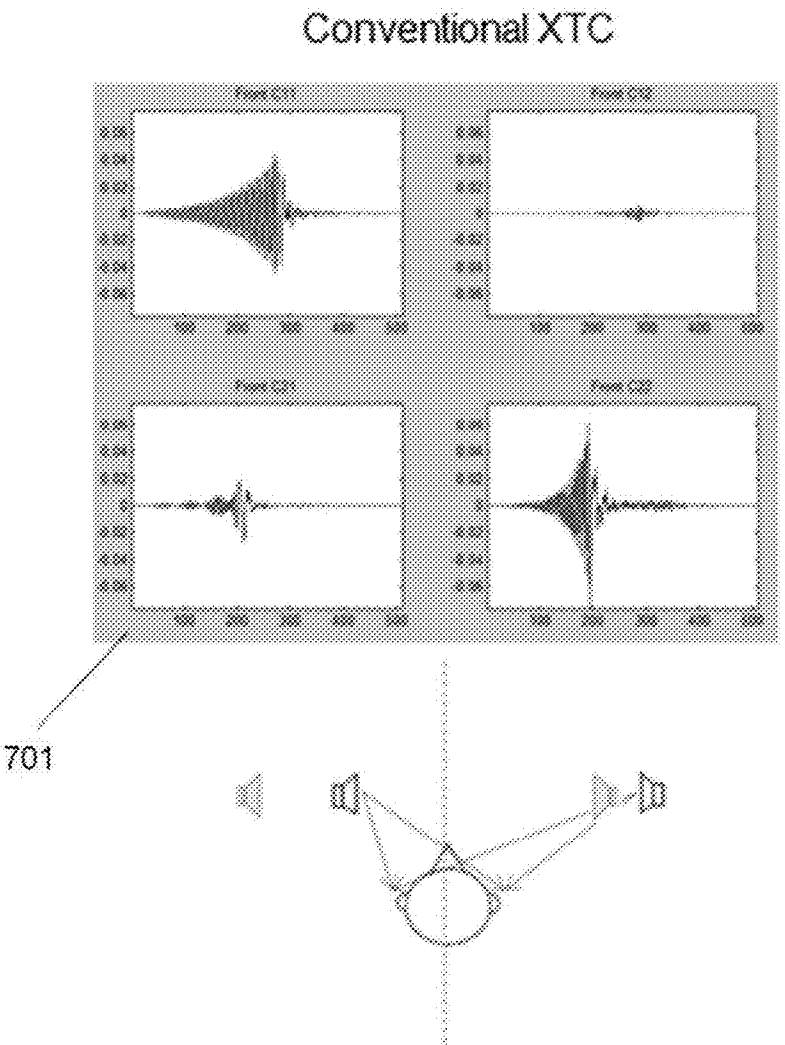

FIG. 7 compares the responses of filters that are configured to weight signals according to a conventional cross-talk algorithm (701) and filters that are configured to weight signals using weights derived from the technique of optimised virtual source rendering with multiple constraints that is described herein (702). Both techniques were used to create a pair of widened virtual sources for the same set of asymmetrical speakers. The constrained energy attenuation of the left channel filter gain using the proposed method can be clearly seen (703), which leads to a balanced stereo sweetspot. Additionally, the pre-echoes of the filter in the proposed method are significantly reduced, which leads to better play back quality and fewer artifacts. A subjective listening test using a human listener was conducted and also verified the effectiveness of virtual sound widening and stereo sweet-spot balancing with the technique of optimised virtual source rendering with multiple constraints that is described herein.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present disclosure may consist of any such individual feature or combination of features. In view of the foregoing description it will be evident to a person skilled in the art that various modifications may be made within the scope of the disclosure.

What is claimed is:

1. A signal generator comprising:

an input configured to receive at least two audio signals; and one or more filters configured to apply weights to the at least two audio signals to generate weighted audio signals and to provide the weighted audio signals to at least two speakers;

wherein the weights applied by the one or more filters to the audio signals are derived by:

identifying a first constraint that limits a weight that can be applied to an audio signal to be provided to a first speaker;

determining a characteristic of a second speaker that affects how a user would perceive audio signals output by the second speaker relative to audio signals output by the first speaker;

determining a second constraint based on the characteristic of the second speaker and the first constraint; and determining the weights so as to minimize a difference between an actual balance of each signal that is expected to be heard by the user when the weighted audio signals are output by the first and second speakers and a target balance, wherein the weights applied to audio signals to be provided to the first speaker are based on the first constraint, and the weights applied to audio signals to be provided to the second speaker are based on the second constraint.

2. The signal generator according to claim 1, wherein the weights applied by the one or more filters are derived by:

determining an attenuation factor for stereo balancing based on the characteristic of the second speaker; and determining the first constraint based on the attenuation factor.

3. The signal generator according to claim 1, wherein the first and second speakers are different distances away from the user, and wherein the weights applied by the one or more filters are derived by determining the characteristic of the second speaker to be a relative distance of the second speaker from the user compared with the first speaker from the user.

4. The signal generator according to claim 3, wherein the weights applied by the one or more filters are derived by determining the relative distance to be:

$$\tau(k) = \frac{d1^2}{d2^2},$$

where d1 is the distance between the second speaker and the user and d2 is the distance between the first speaker and the user, wherein k is a frequency index.

5. The signal generator according to claim 1, wherein the first and second speakers have different frequency responses, and wherein the weights applied by the one or more filters are derived by determining the characteristic of the second speaker to be a relative frequency response of the second speaker compared with the first speaker.

6. The signal generator according to claim 5, wherein the weights applied by the one or more filters are derived by determining the relative frequency response to be:

$$\tau(k) = \frac{|t1(k)|^2}{|t2(k)|^2},$$

where $t_1(k)$ is the impulse response of the second speaker and $t_2(k)$ is the impulse response of the first speaker, wherein k is a frequency index.

7. The signal generator according to claim 1, wherein the weights applied by the one or more filters are derived by determining the first constraint to be a maximum gain associated with the at least two speakers.

8. The signal generator according to claim 7, wherein the at least two speakers are located in a car, and wherein the first constraint is a maximum gain associated with the most distant speaker to the user of the at least two speakers.

9. The signal generator according to claim 1, wherein the weights applied by the one or more filters are derived by determining the weights such that a sum of the squares of the weights to be applied to the audio signals to be provided to one speaker of the at least two speakers does not exceed a constraint for the one speaker.

10. The signal generator according to claim 1, wherein the weights applied by the one or more filters are derived by determining the target balance based on a physical arrangement of the at least two speakers relative to the user.

11. The signal generator according to claim 1, wherein the weights applied by the one or more filters are derived by determining the target balance so as to simulate speakers that are symmetrically arranged with respect to the user.

12. The signal generator according to claim 1, wherein the weights applied by the one or more filters are derived by determining the target balance so as to simulate speakers that are further apart than the at least two speakers.

13. The signal generator according to claim 1, wherein the first and second speakers are different distances away from the user, the method further comprising:

determining the characteristic of the second speaker to be a relative distance of the second speaker from the user compared with the first speaker from the user.

14. The signal generator according to claim 1, wherein the first and second speakers have different frequency responses, the method further comprising:

determining the characteristic of the second speaker to be a relative frequency response of the second speaker compared with the first speaker.

15. A method comprising:

receiving at least two audio signals;

identifying a first constraint that limits a weight that can be applied to an audio signal to be provided to a first speaker;

determining a characteristic of a second speaker that affects how a user would perceive audio signals output by the second speaker relative to audio signals output by the first speaker;

determining a second constraint based on the characteristic of the second speaker and the first constraint;

determining weights to apply to the at least two audio signals to generate weighted audio signals so as to minimize a difference between an actual balance of each signal that is expected to be heard by the user when the weighted audio signals are output by the first and second speakers and a target balance, wherein the weights applied to audio signals to be provided to the first speaker are based on the first constraint, and the weights applied to audio signals to be provided to the second speaker are based on the second constraint;

applying the weights to the audio signals to generate the weighted audio signals; and providing the weighted audio signals to at least two speakers including the first speaker and the second speaker.

16. The method according to claim 15, further comprising:

determining an attenuation factor for stereo balancing based on the characteristic of the second speaker; and determining the first constraint based on the attenuation factor.

17. A non-transitory machine readable storage medium having stored thereon processor executable instructions for controlling a computer to carry out the following operations:

receiving at least two audio signals;

identifying a first constraint that limits a weight that can be applied to an audio signal to be provided to a first speaker;

determining a characteristic of a second speaker that affects how a user would perceive audio signals output by the second speaker relative to audio signals output by the first speaker;

determining a second constraint based on the characteristic of the second speaker and the first constraint;

determining weights to apply to the at least two audio signals to generate weighted audio signals so as to minimize a difference between an actual balance of each signal that is expected to be heard by the user when the weighted audio signals are output by the first and second speakers and a target balance, wherein the weights applied to audio signals to be provided to the first speaker are based on the first constraint, and the weights applied to audio signals to be provided to the second speaker are based on the second constraint;

applying the weights to the audio signals to generate the weighted audio signals; and providing the weighted audio signals to at least two speakers including the first speaker and the second speaker.

18. The machine readable storage medium according to claim 17, the operations further comprising:

determining an attenuation factor for stereo balancing based on the characteristic of the second speaker; and determining the first constraint based on the attenuation factor.

19. The machine readable storage medium according to claim 17, wherein the first and second speakers are different distances away from the user, the operations further comprising:

determining the characteristic of the second speaker to be a relative distance of the second speaker from the user compared with the first speaker from the user.

20. The machine readable storage medium according to claim 17, wherein the first and second speakers have different frequency responses, the operations further comprising:

determining the characteristic of the second speaker to be a relative frequency response of the second speaker compared with the first speaker.

* * * * *